US006926520B2

(12) United States Patent
Home

(10) Patent No.: US 6,926,520 B2
(45) Date of Patent: Aug. 9, 2005

(54) HEATER FOR OUTDOORS

(75) Inventor: William Home, Neihu (TW)

(73) Assignee: Grand Hall Enterprise Co., Ltd., Neihu (TW)

( * ) Notice: Subject to any disclaimer, the term of this patent is extended or adjusted under 35 U.S.C. 154(b) by 0 days.

(21) Appl. No.: 10/810,629

(22) Filed: Mar. 29, 2004

(65) Prior Publication Data

US 2005/0147937 A1 Jul. 7, 2005

(30) Foreign Application Priority Data

Jan. 6, 2004 (TW) ..... 93200188 U

(51) Int. Cl.[7] ..... F23D 14/62
(52) U.S. Cl. ..... 431/354; 431/328
(58) Field of Search ..... 431/354, 328, 431/326; 126/92 R, 92 AC, 92 B, 85 R; 108/150, 151, 50.12, 50.13, 158, 44; 362/102; D23/328, 342; 135/16

(56) References Cited

U.S. PATENT DOCUMENTS 5,964,233 A * 10/1999 Clark et al. ..... 135/16
6,192,878 B1 * 2/2001 Waters ..... 126/92 AC
6,298,866 B1 * 10/2001 Molnar, IV ..... 135/16
D462,426 S * 9/2002 Jeng ..... D23/328

* cited by examiner

*Primary Examiner*—Alfred Basichas
(74) *Attorney, Agent, or Firm*—Leong C. Lei

(57) ABSTRACT

An improved structure of a heater for an outdoor table is disclosed. The heater has a base seat mounted with an isolation plate, a pair of semi-stacking male tubes with multiple corners and a screw nut with a circular press plate at the top end thereof, and the two ends of the isolation plate are connected to the bottom inner edge of the base seat for securing and the center of the isolation plate is provided with a recessed sunken seat which is engageable with the multiple corners of the male tubes, and the center of the sunken seat is provided with through hole for mounting with a pair of the semi-stacking male tubes and the external diameter of the male tubes is smaller than an umbrella hole on the table surface, and is engageable with a screw nut, thereby when the base seat is placed on the table, the male tube is inserted into the umbrella hole and the screw nut is mounted to the male tube from the bottom of the table and the bottom edge of the base seat and the circular press plate clip the edged wall of the umbrella hole so that the heater is secured to the table.

4 Claims, 5 Drawing Sheets

HEATER FOR OUTDOORS

BACKGROUND OF THE INVENTION (a) Technical Field of the Invention

The present invention relates to a heater, and in particular, a heater for outdoor use which can be placed on an outdoor table or the like.

(b) Description of the Prior Art

An outdoor table 10 with a collapsible umbrella 30, as shown in FIG. 1, is commonly found in garden or at picnic area. The table surface 11 has an umbrella 30 mounted into an umbrella hole 20 on the table surface 11. In winter or on a cold weather, the umbrella 30 is replaced with a heater 40, as shown in FIG. 2, which provides heat and illumination. The heater 40 is an upright structure with a lamp hood 41 at the top of the heater 40. The bottom of the heater 40 is a base seat 42 connected to a tube 51 connected to a tank 50 containing LPG through the umbrella hole 20. By triggering the ignition button 43 of the heater 40, a flame is obtained at the mouth 44 of the heater 40 to provide warmth and illumination. Conventional heater 40 only has the base seat 42 to sit on the table surface and there is no other element to prevent the heater 40 from toppling. Accordingly, it is an object of the present invention to provide a heater for outdoors which can mitigate the above drawback.

SUMMARY OF THE INVENTION

Accordingly, it is an object of the present invention is to provide an improved structure of a heater for outdoor table having a base seat mounted with an isolation plate, a pair of semi-stacking male tubes with multiple corners and a screw nut with a circular press plate at the top end thereof, and the two ends of the isolation plate are connected to the bottom inner edge of the base seat for securing and the center of the isolation plate is provided with a recessed sunken seat which is engageable with the multiple corners of the male tubes, and the center of the sunken seat is provided with through hole for mounting with a pair of the semi-stacking male tubes and the external diameter of the male tubes is smaller than an umbrella hole on the table surface, and is engageable with a screw nut, thereby when the base seat is placed on the table, the male tube is inserted into the umbrella hole and the screw nut is mounted to the male tube from the bottom of the table and the bottom edge of the base seat and the circular press plate clip the edged wall of the umbrella hole so that the heater is secured to the table.

Yet another object of the present invention is to provide a heater for outdoor, wherein the surrounding of the screw nut is radially mounted with a plurality of rotating plates.

Still another object of the present invention is to provide a heater for outdoor, wherein a through hole is provided to the surrounding of the screw nut at appropriate position thereof.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
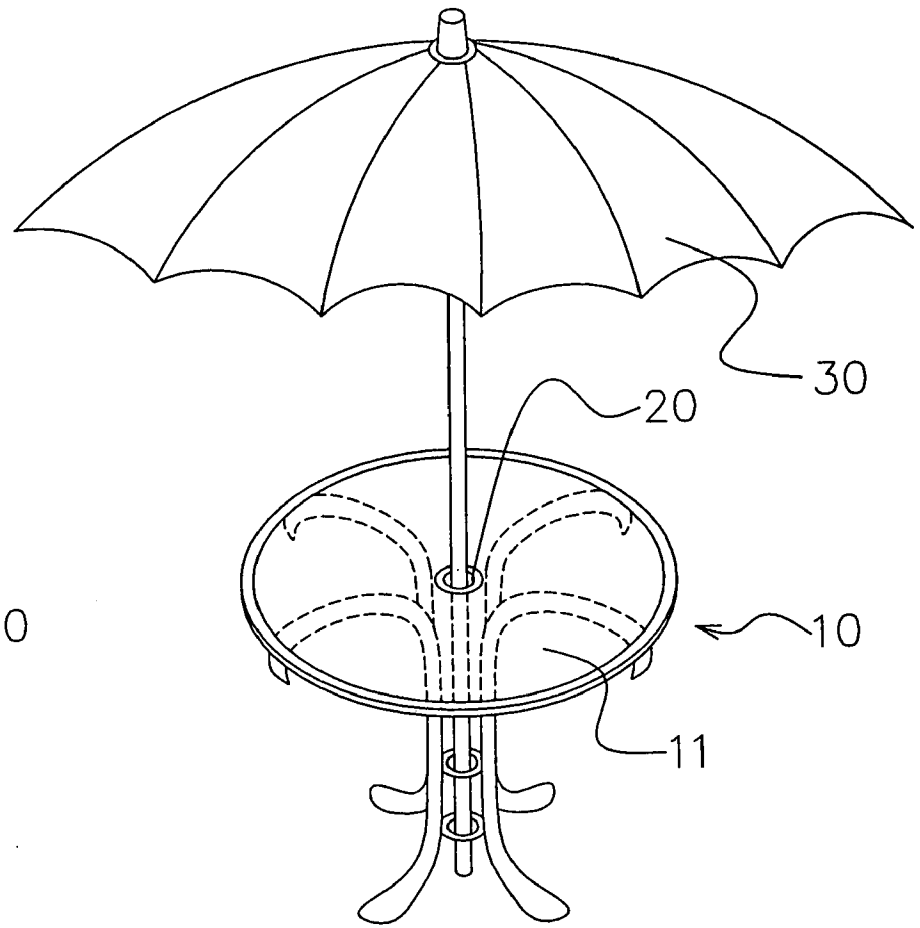
PRIOR ART FIG. 1
FIG. 1 is a perspective view showing a table inserted with a collapsible umbrella.
Figure 2:
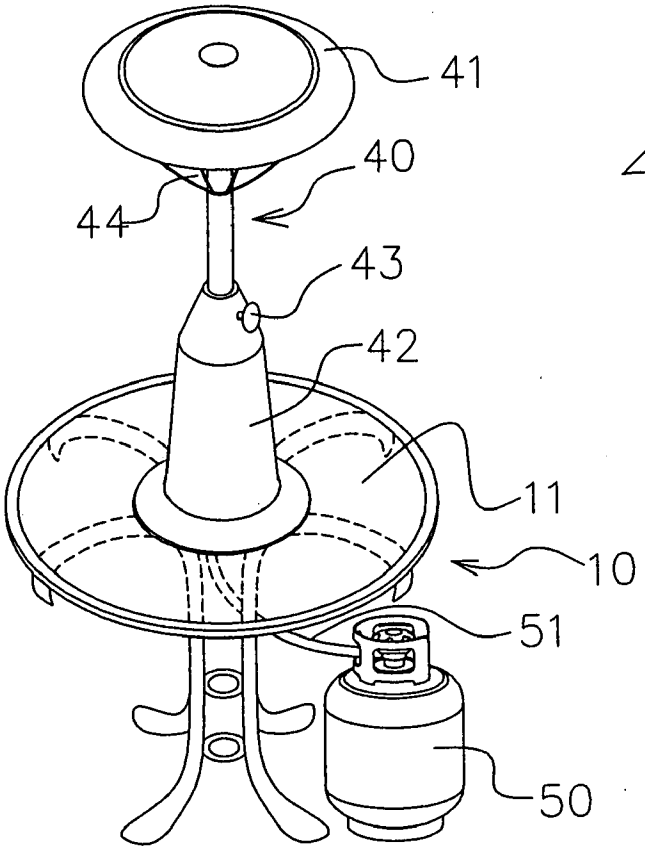
PRIOR ART FIG. 2
FIG. 2 is a conventional heater mounted onto a table.
Figure 3:
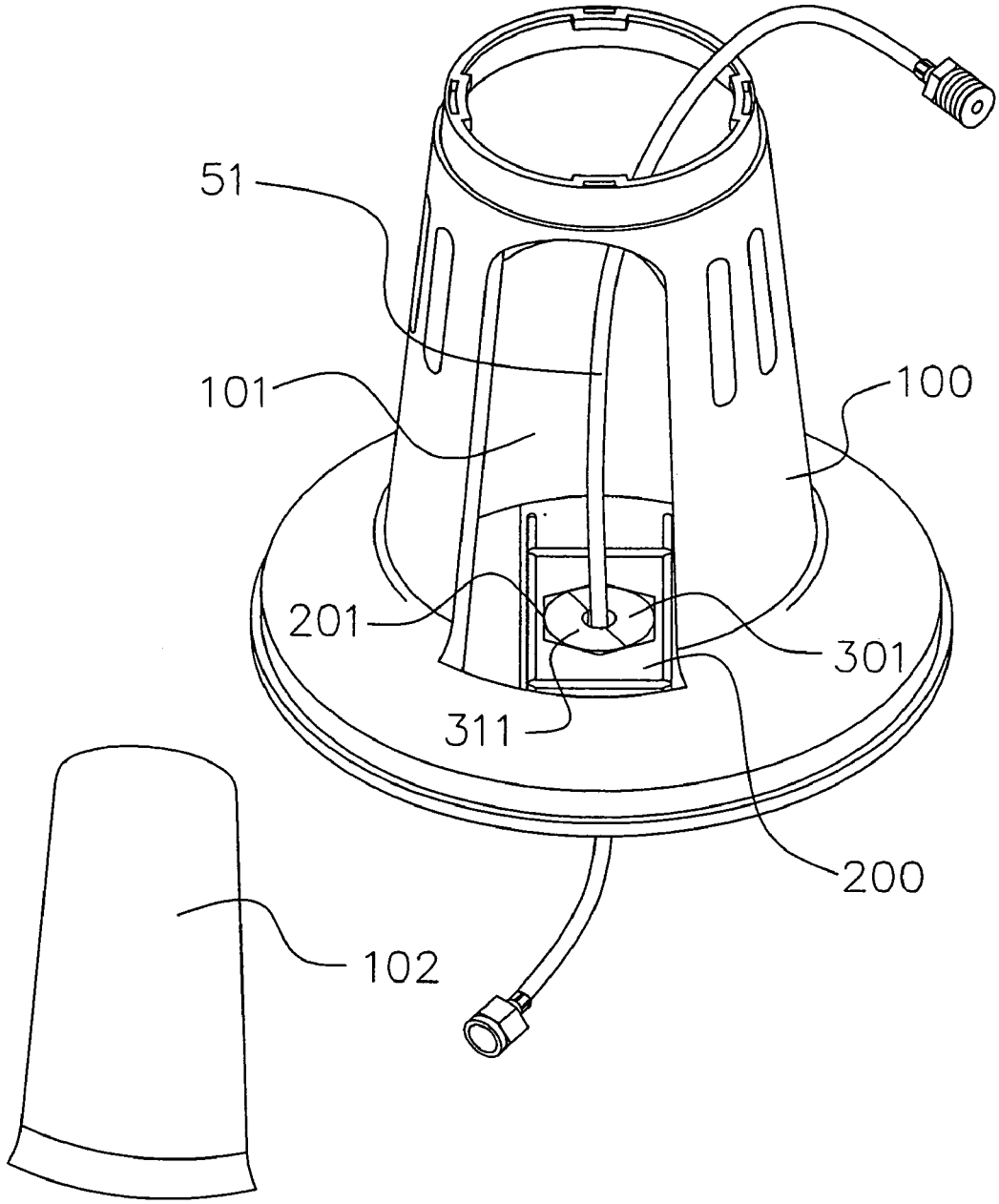
FIG. 3 is a perspective view of a table-top heater in accordance with the present invention.
Figure 4:
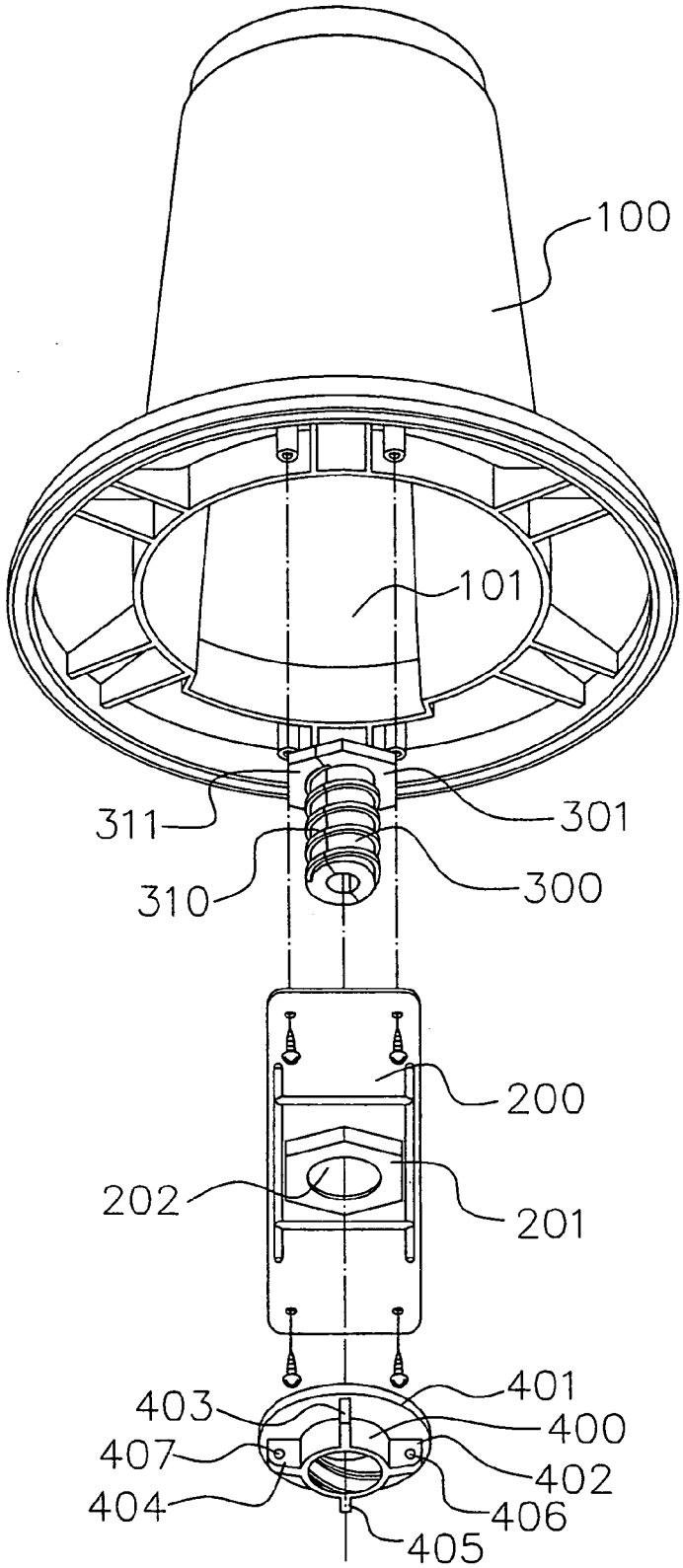
FIG. 4 is an exploded view of the table-top heater of the present invention.

FIG. 1 is a perspective view of a table inserted with a collapsible umbrella. FIG. 2 shows the heater to be mounted onto a table top. Referring to FIGS. 3 and 4, the heater has a base seat 100 having a bottom mounted with an isolation plate 200, a pair of semi-stacking male tubes 300, 310 with multiple corners 301, 311, and a screw nut 400 with a circular press plate 401. The two ends of the isolation plate 200 are connected to the bottom inner edge of the base seat 100 for securing and the center of the isolation plate 200 is provided with a recessed sunken seat 201. The sunken seat 201 is engageable with the corners 301, 311 of the male tubes 300, 310. The center of the sunken seat 201 is provided with through hole 202 for mounting with a pair of the semi-stacking male tubes 300, 310. The external diameter of the male tubes 300, 310 is smaller than the umbrella hole (not shown) on the table surface, and is engageable with the screw nut 400. The external diameter of the circular press plate 401 of the screw nut 400 is larger than the umbrella hole and the surrounding of the screw nut 400 is mounted radially with a plurality of rotating plates 402, 403, 404, 405 facilitating rotating with hands. Through holes 406, 407 are provided to the rotating plates 402, 403, 404, 405. In addition, the surrounding of the base seat 100 is provided with a hole 101 covered with a fastening cap 102 to facilitate a hand to be inserted thereto to connect to a gas outlet tube 51, or to place a male tubes 300, 310 so that the corners 301, 311 are placed to the sunken seat 201.

Figure 5:
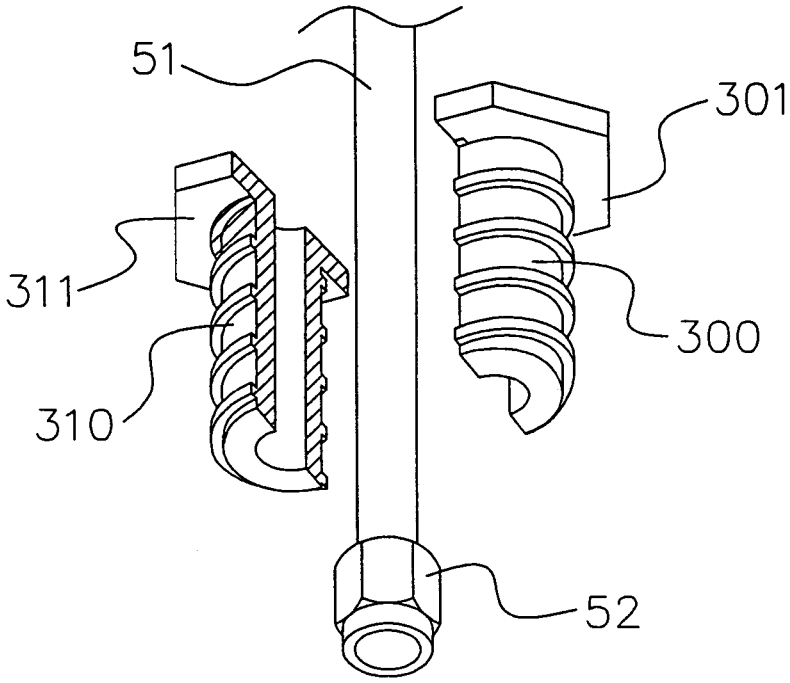
FIG. 5 is an exploded perspective view showing the stacking male tube of the heater in accordance with the present invention.
Figure 6:
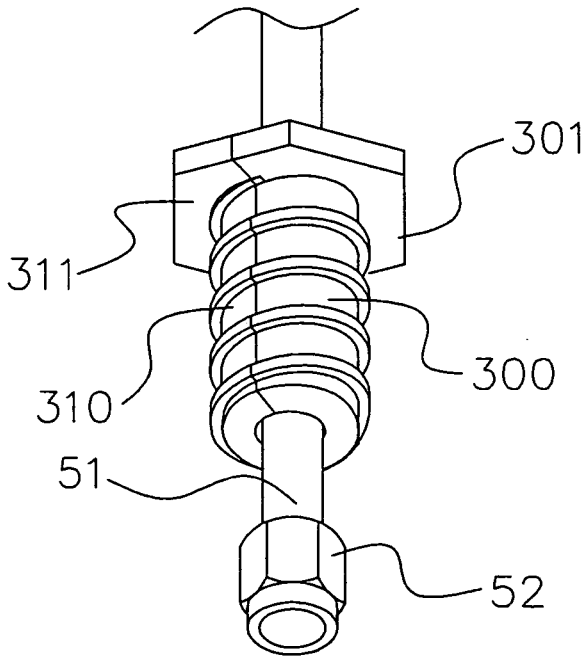
FIG. 6 is a perspective view showing the male tube of the heater of the present invention.
Figure 7:
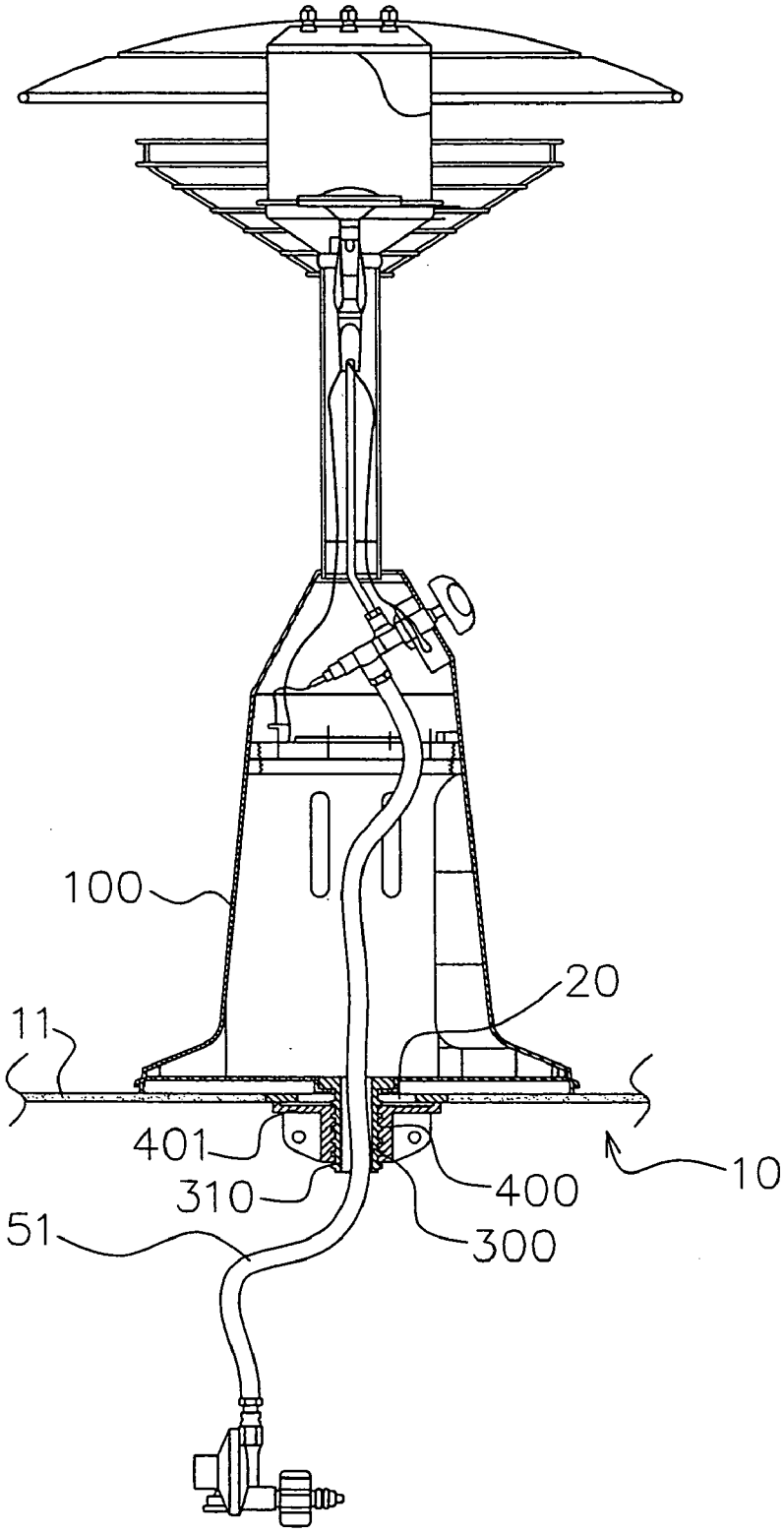
FIG. 7 is a sectional view showing the heater mounted onto an outdoor table in accordance with the present invention.

As shown in FIG. 5, there is shown the structure of the semi-stacking male tubes 300, 310. The external diameter of the connector 52 of the gas outlet tube is larger than the tube hole of tubes 300, 310. The tubes 300, 310 can be triggered halfway which can clip the gas outlet tube 51 into the hole of the tubes 300, 310. As shown in FIG. 6, the tubes 300, 310 are stacked so that it can be slidably moved the gas outlet tube. As shown in FIG. 7, the base seat 100 is placed onto the table surface 11 of the table 10 and the male tubes 300, 310 of the tube 51 is inserted into the umbrella hole 20. The screw nut 400 is pressed against the male tubes 300, 310 such that the bottom edge of the base seat and the circular press plate 401 clip to the edged wall of the umbrella hole. Thus, the heater of the present invention is secured to the table 10. The lower holes 406, 407 allow the tank containing LPG to be chained to the bottom of the table and the tank will not be toppled.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An improved structure of a heater for an outdoor table having a base seat mounted with an isolation plate, a pair of semi-stacking male tubes with multiple corners and a screw nut with a circular press plate at a top end thereof, and two ends of the isolation plate are connected to a bottom inner edge of the base seat for securing and a center of the isolation plate is provided with a recessed sunken seat which is engageable with the multiple corners of the male tubes, and a center of the sunken seat is provided with a through hole for mounting with the semi-stacking male tubes and an external diameter of the male tubes is smaller than an umbrella hole on the table, and is engageable with the screw nut, thereby when the base seat is placed on the table, the male male tubes are inserted into the umbrella hole and the screw nut is mounted to the male tubes from a bottom of the table and a bottom edge of the base seat and the circular press plate clip an edged wall of the umbrella hole so that the heater is secured to the table.

2. The heater for an outdoor table of claim 1, wherein surrounding of the screw nut is radially mounted with a plurality of rotating plates.

3. The heater for an outdoor table of claim 1, wherein a through hole is provided to surrounding portion of the screw nut.

4. The heater for an outdoor table of claim 1, wherein surrounding portion of the base seat is provided with an opening which is covered with a fastening cap.

* * * * *